US011014388B2

(12) United States Patent
Yoshikawa

(10) Patent No.: US 11,014,388 B2
(45) Date of Patent: May 25, 2021

(54) TEST PATTERN FORMATION METHOD, LANDING DEVIATION AMOUNT ACQUISITION METHOD, AND RECORDING DEVICE

(71) Applicant: SEIKO EPSON CORPORATION, Tokyo (JP)

(72) Inventor: Eishin Yoshikawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/559,729

(22) Filed: Sep. 4, 2019

(65) Prior Publication Data

US 2020/0079123 A1 Mar. 12, 2020

(30) Foreign Application Priority Data

Sep. 6, 2018 (JP) ..... JP2018-166984

(51) Int. Cl.

| | |
|---|---|
| ***B41J 29/393*** | (2006.01) |
| ***B41J 19/14*** | (2006.01) |
| ***B41J 2/21*** | (2006.01) |
| *B41J 2/045* | (2006.01) |

(52) U.S. Cl.

CPC ..... *B41J 29/393* (2013.01); *B41J 2/2114* (2013.01); *B41J 19/145* (2013.01); *B41J 2/04516* (2013.01); *B41J 2/2146* (2013.01); *B41J 2029/3935* (2013.01)

(58) Field of Classification Search

CPC ..... B41J 2/2146; B41J 2/2117; B41J 19/145; B41J 2/2114; B41J 2/04516; B41J 2/2142; B41J 29/393; B41J 2029/3935

See application file for complete search history.

(56) References Cited

U.S. PATENT DOCUMENTS

2005/0093904 A1 5/2005 Ishimoto et al.
2015/0328881 A1* 11/2015 Ebisawa ..... B41J 2/16585 347/9

FOREIGN PATENT DOCUMENTS

JP 2005-047024 A 2/2005

* cited by examiner

*Primary Examiner* — Geoffrey S Mruk

(74) *Attorney, Agent, or Firm* — Global IP Counselors, LLP

(57) ABSTRACT

A test pattern formation method includes preparing a first pattern including a plurality of dot rows that are separated, and a second pattern including a plurality of regions having a width greater than a width of the plurality of dot rows and provided spaced apart by a plurality of gaps greater than or equal to the width of the plurality of dot rows. At least a portion of the first pattern and at least a portion of the second pattern are in positions overlapping each other. Given a largest overlap between one of the plurality of dot rows and one of the plurality of gaps as a reference, the other dot rows of the plurality of dot rows and the plurality of regions having a wide width overlap and are deviated from each other incrementally by a respective distance corresponding to a landing deviation amount.

4 Claims, 10 Drawing Sheets

TEST PATTERN FORMATION METHOD, LANDING DEVIATION AMOUNT ACQUISITION METHOD, AND RECORDING DEVICE

The present application is based on, and claims priority from JP Application Serial Number 2018-166984, filed Sep. 6, 2018, the disclosure of which is hereby incorporated by reference herein in its entirety.

BACKGROUND

1. Technical Field

The present disclosure relates to a test pattern formation method, a landing deviation amount acquisition method, and a recording device.

2. Related Art

In a recording device such as a printer, transparent ink, which is a colorless transparent ink, may be used in addition to colored ink, such as cyan, magenta, yellow, and black (CMYK), in order to obtain a base formation before discharge of the colored ink, a glossiness of the discharged colored ink, or the like. Similar to the colored ink, the transparent ink is discharged from a nozzle of a discharge head included in the recording device, and lands on a recording medium. Therefore, when there is a deviation amount in a landing position of the transparent ink, the landing position may be corrected in the same manner as the colored ink.

Nevertheless, because the transparent ink is colorless and transparent, it is difficult to identify the landing position after discharge. As a result, various investigations have been conducted to identify the landing position of the transparent ink. For example, JP-A-2005-47024 discloses a method for visually recognizing a transparent ink and detecting a deviation in a position of landing by irradiating the transparent ink with ultraviolet light.

However, in the technique described in JP-A-2005-47024, a special recording medium containing phosphors needs to be prepared in order to identify the position where the transparent ink has landed.

SUMMARY

According to an aspect of the present disclosure, a test pattern formation method for a recording device including a first discharge unit configured to discharge colored ink onto a recording medium, and a second discharge unit configured to discharge transparent ink onto the recording medium, is provided. The test pattern formation method includes preparing a first pattern including a plurality of dot rows separated in a direction intersecting the plurality of dot rows, and a second pattern including a plurality of regions having a width greater than a width of the plurality of dot rows, the plurality of regions being provided in the direction and spaced apart by a plurality of gaps greater than or equal to the width of the plurality of dot rows. At least a portion of the first pattern discharged by driving of the first discharge unit and at least a portion of the second pattern discharged by driving of the second discharge unit are formed in positions overlapping each other. In this position, given a largest overlap between one of the plurality of dot rows and one of the plurality of gaps as a reference, the other dot rows of the plurality of dot rows and the plurality of regions overlap at positions that deviate from each other incrementally by a distance corresponding to a landing deviation amount.

DESCRIPTION OF EXEMPLARY EMBODIMENTS

A. First Exemplary Embodiment

Figure 1:
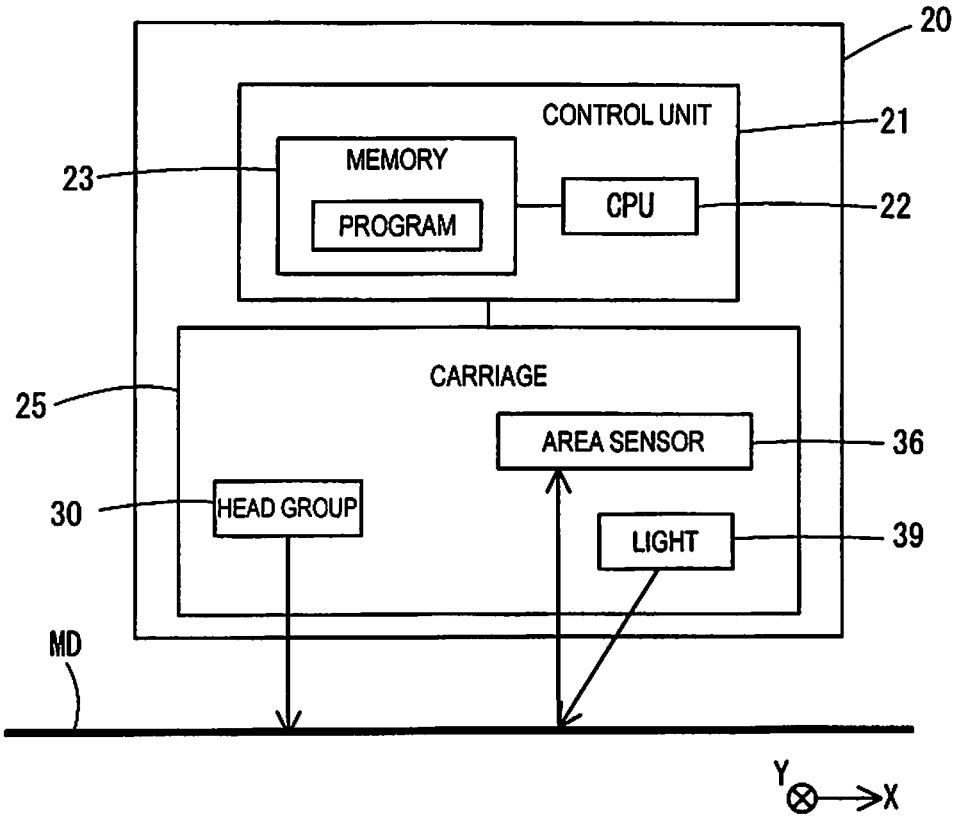
FIG. 1 is a block diagram illustrating functions of a printing device.

FIG. 1 is a block diagram schematically illustrating functions of a printing device 20. In FIG. 1, an X direction and a Y direction are illustrated. The X direction represents a main scanning direction, and the Y direction represents a sub scanning direction. A positive side in the Y direction is downstream of sub scanning. That is, a printing medium MD is transported in an orientation along the Y direction.

In addition to normal printing functions, the printing device 20 has a function of measuring and correcting a landing deviation described later. The printing device 20 includes a control unit 21 and a carriage 25. The control unit 21 includes central processing unit (CPU) 22 and a memory 23. The carriage 25 includes a print head group 30, an area sensor 36, and a light 39.

The printing device 20 scans the carriage 25 along the main scanning direction X, and transports the printing medium MD along the sub scanning direction Y. The print head group 30 of the printing device 20 includes nozzles arranged in a direction intersecting the main scanning direction X. The print head group 30 discharges ink while reciprocating relative to the printing medium MD along the main scanning direction X, and forms dots on the printing medium MD along the main scanning direction x. A line of dots along the main scanning direction X is also referred to as a raster.

An ink cartridge (not illustrated) for each ink color is mounted on the carriage 25. The printing device 20 according to this exemplary embodiment includes a first discharge unit configured to discharge colored ink, and a second discharge unit configured to discharge a transparent ink, and discharges seven types of ink. Six of the seven types are cyan, magenta, yellow, black, light cyan, and light magenta, that is CMYKLcLm. These six types are collectively referred to as colored ink. The ink colors of the colored ink may include white, and white ink may be added to the print head group 30. Another one of the seven types of ink is transparent ink. In this exemplary embodiment, the transparent ink is a colorless transparent ink, and is used to adjust the glossiness of a printed image. The transparent ink may be ink utilized in preprocessing prior to the printing of the colored ink.

As the printing medium MD of this exemplary embodiment, photographic paper is used. The printing medium MD is not limited to photographic paper, and printing paper having low ink permeability upon printing compared to plain paper, such as glossy paper, can be employed. Further, a pigment ink is employed as the ink of the exemplary embodiment. The ink is not limited to a pigment ink, and various inks having low permeability into the printing medium MD can be employed. Thus, in the printing device 20 according to the exemplary embodiment, a combination of the type of the printing medium MD and the type of the ink is set so that the permeability of the colored ink into the printing medium MD is low. This information is stored in advance in the memory 23 as setting values for the print processing.

The area sensor 36 is an imaging unit configured to acquire an image on the printing medium MD and measure a density value. The light 39 irradiates visible light toward a measurement range of the area sensor 36 on the printing medium MD. The measurement result from the area sensor 36 is transmitted to the control unit 21, and is used in landing deviation amount measurement processing described later.

The control unit 21 is constituted with the CPU 22 and the memory 23, and manages the overall control of the printing device 20. Dot formation by each of the discharge units and measurement of the density value by the area sensor 36 described above are controlled by the CPU 22. The memory 23 stores a program for realizing the print processing described later. The print processing is processing for the dot formation and measurement of the density value described above.

Figure 2:
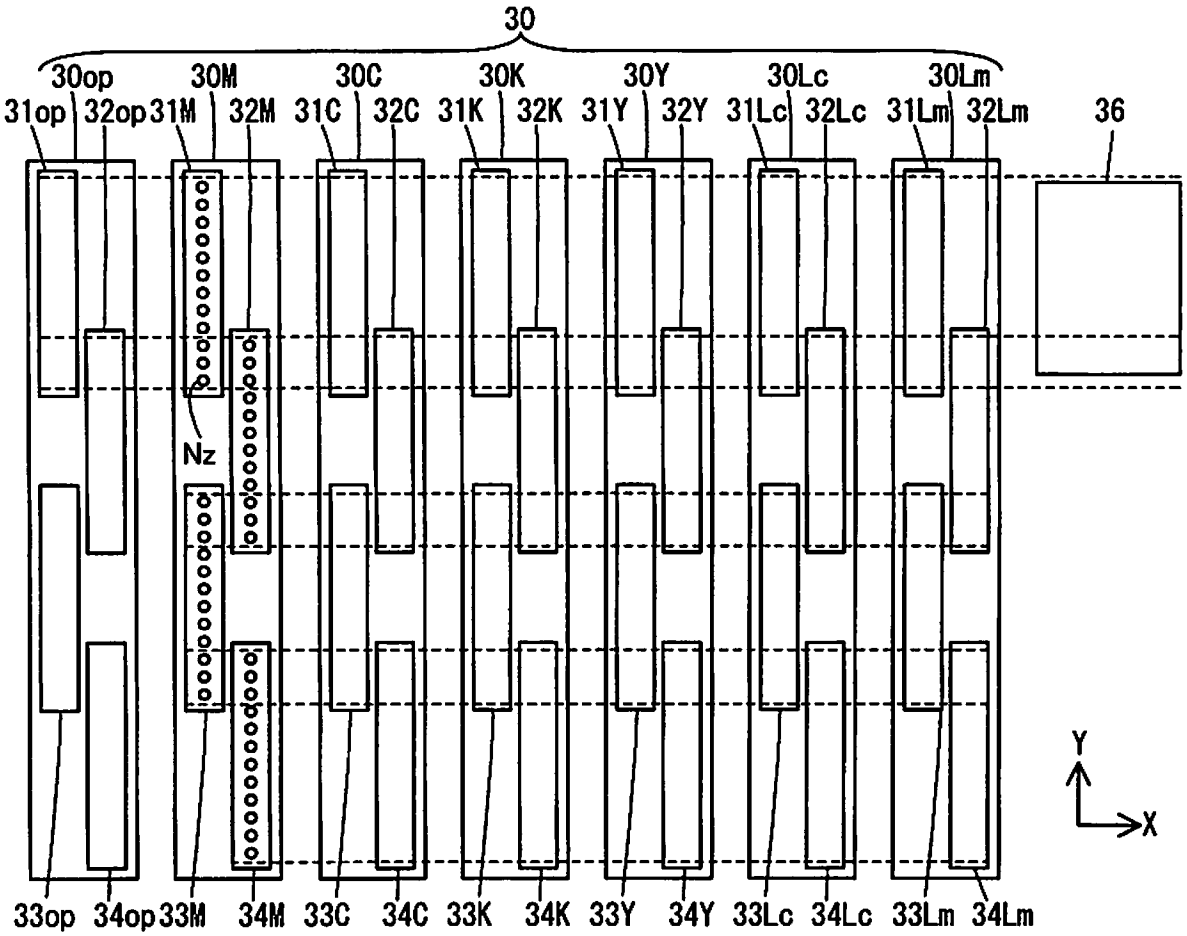
FIG. 2 is a top view schematically illustrating a print head group.

FIG. 2 is a top view schematically illustrating the print head group 30. The print head group 30 is constituted with a print head corresponding to each type of ink described above. More specifically, the print head group 30 is constituted with a magenta print head 30M, a cyan print head 30C, a black print head 30K, a yellow print head 30Y, a light cyan print head 30Lc, a light magenta print head 30Lm, and a transparent ink print head 30*op*.

Hereinafter, a configuration of the print head will be described using the magenta print head 30M as an example. The description of the print head is common to all print heads, except for the difference in ink color. The magenta print head 30M includes a first print chip 31M to a fourth print chip 34M. A plurality of nozzles Nz are provided on each print chip. The number and arrangement of the nozzles Nz can be set as appropriate. Ink droplets are discharged from each nozzle Nz. The second print chip 32M to the fourth print chip 34M are also provided with the nozzles Nz in the same manner as in the first print chip 31M. Note that the nozzles Nz are illustrated only in the magenta print head 30M, and illustration in the other print heads is omitted for convenience.

Regions printed by the first print chip 31M to the fourth print chip 34M each include an overlapping region. The overlapping region is a region where dots can be formed by any of two adjacent print chips mounted on print heads corresponding to the same color. For example, the second print chip 32M has an overlapping region with the first print chip 31M and an overlapping region with the third print chip 33M. For example, the third print chip 33M has an overlapping region with the fourth print chip 34M. On the other hand, a region that is not an overlapping region is referred to as an independent region. In FIG. 2, a dashed line is illustrated as a boundary between an overlapping region and an independent region.

In the printing device 20 according to the exemplary embodiment, control is executed to adjust a deviation in a landing position of the ink between the print heads across each color of the print head group 30. In the printing device 20 according to the exemplary embodiment, first the deviation in the landing position of the ink between each print head for the colored ink of the print head group 30, excluding the transparent ink print head 30*op*, is adjusted. Subsequently, the deviation in the landing position of the ink of the transparent ink print head 30*op* is adjusted using the transparent ink print head 30*op* and the magenta print head 30M. At this time, in the printing device 20, a test pattern 40 for detecting the deviation in the landing position of the ink of the transparent ink print head 30*op* and the colored ink print heads is printed. The test pattern 40 used at this time is described below.

Figure 3:
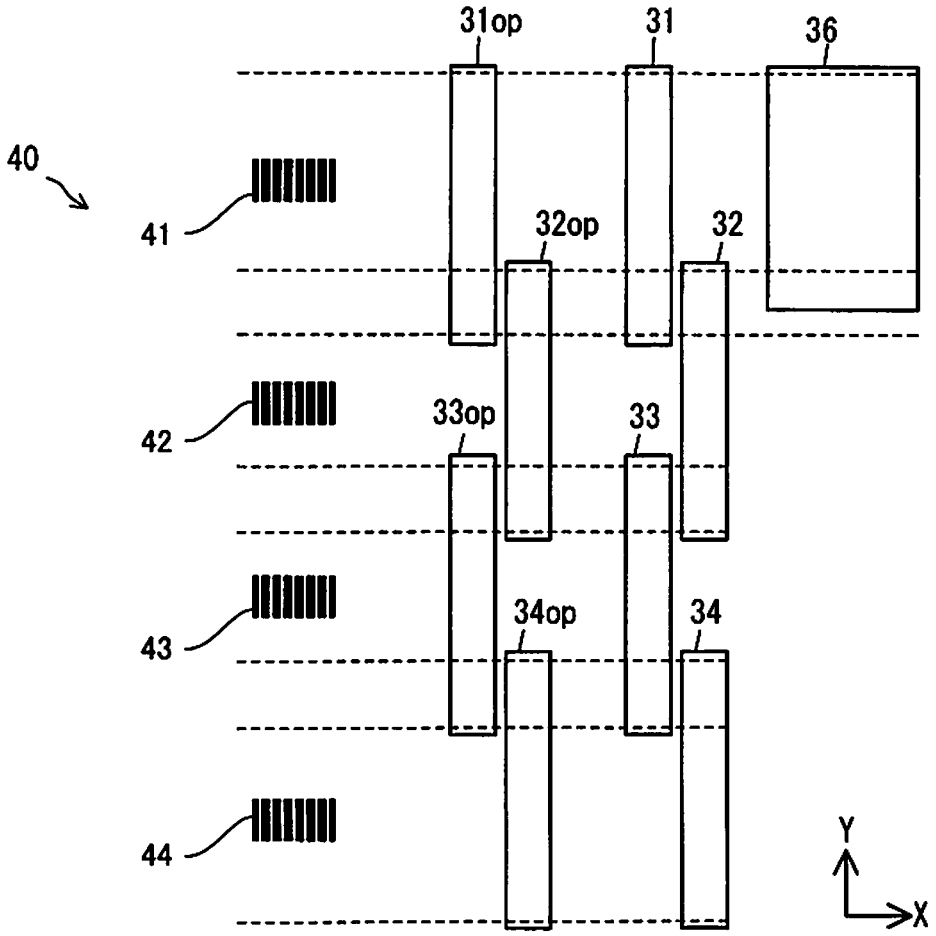
FIG. 3 is an explanatory view illustrating a positional relationship between a test pattern and each print head.

FIG. 3 is an explanatory view illustrating a positional relationship between the test pattern 40 and each print head. The test pattern 40 is for measuring the landing deviation in the X direction between print heads. To illustrate the positional relationship with the test pattern, FIG. 3 illustrates first to fourth print chips 31*op* to 34*op* for transparent ink, first to fourth print chips 31 to 34, and the area sensor 36. The first print chip 31 is a name used when referring to the first print chip mounted on each head corresponding to the six colored inks, without distinction. The same applies to the second to fourth print chips 32 to 34.

The test pattern 40 is constituted with a first area 41 to a fourth area 44. The configurations of the first area 41 to the fourth area 44 are the same, but the inspected print chip is different. The first area 41 to the fourth area 44 are each formed at different positions in the Y direction to be included in the independent region of the respective print chips 31 to 34. The first area 41 to the fourth area 44 are formed by ink sprayed from nozzles included in the independent regions. These areas are also collectively referred to as the head area below. The head area is an area for measuring the landing deviation of the ink between print heads.

An image of the test pattern 40 is captured by the area sensor 36. The image of the test pattern 40 is captured by combining main scanning and sub scanning. The sub scanning is performed so that the first area 41 to the fourth area 44 are each within the image capturing range. Image capturing of the test pattern 40 is started and, as soon as the imaging of a first location ends, measurement of the landing deviation amount is started in parallel with image capturing of another area. Image capturing of the test pattern 40 and measurement of the landing deviation amount may be performed in parallel in this way, or measurement may be started after the image capturing of all test patterns 40 has been completed.

Figure 4:
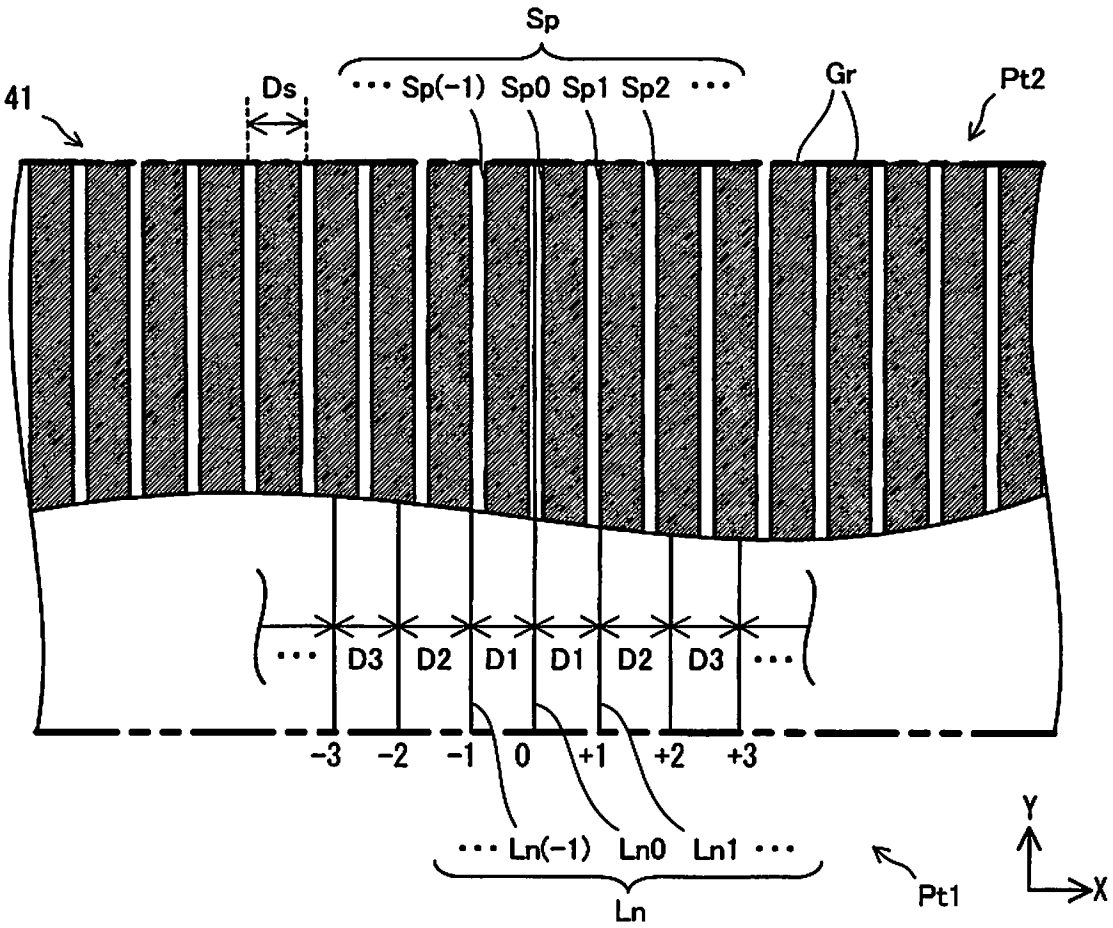
FIG. 4 is an enlarged view schematically illustrating a first area of a test pattern.

FIG. 4 is an enlarged view schematically illustrating the first area 41 of the test pattern 40. Below, a configuration of the test pattern 40 will be described using the first area 41 as an example.

The test pattern 40 is configured by forming a first pattern Pt1 including a plurality of ruled lines Ln and a second pattern Pt2 including a plurality of base regions Gr and gaps Sp so that the first pattern Pt1 and the second pattern Pt2 overlap. The printing device 20 according to the exemplary embodiment detects the landing deviation amount between the magenta print head 30M serving as the first discharge unit and the transparent ink print head 30*op* serving as the second discharge unit from the positional relationship between the first pattern Pt1 and the second pattern Pt2. In FIG. 4, the region forming the base region Gr is indicated by the contour formed by the two-dot chain line, and the region of the lower half of the drawing is illustrated with the second pattern Pt2 omitted for ease of understanding.

The ruled line Ln of the first pattern Pt1 is a dot row in which ink dots of the colored ink magenta are arranged in a straight line along the Y direction. A plurality of the ruled lines Ln are formed arranged and separated from each other to be mutually parallel along the X direction substantially orthogonal to the orientation of the linear dot rows.

On the other hand, the base region Gr of the second pattern Pt2 is a rectangular region having a width wider in the X direction than the dot row of the ruled line Ln, and elongated in the Y direction. A plurality of the base regions Gr are arranged in the X direction with matching widths in the X direction. The base region Gr is formed of a solid coating of transparent ink. The gap Sp is provided between each of the base regions Gr. The gap Sp is a region between each of the base regions Gr where the transparent ink is not discharged. That is, the gap Sp is a region in which the printing medium MD is exposed between the base regions Gr. In the exemplary embodiment, the gap Sp is a rectangular region having a width greater than or equal to the width of the dot row constituting the ruled line Ln in the X direction, and elongated in the Y direction. As a result, the width of the gap Sp in the exemplary embodiment is set to a width sufficient enough to allow each dot of the ruled line Ln to be disposed in the gap Sp without coming into contact with the base regions Gr. The gaps Sp are provided at equal intervals of a distance Ds in the X direction. Note that the orientation in which the ruled lines Ln of the first pattern Pt1 are arranged is not limited to a direction orthogonal to the orientation of the dot rows, and the ruled lines Ln may be separated in any direction intersecting the orientation of the dot rows, such as in a direction corresponding to the deviation amount between the first pattern Pt1 and the second pattern Pt2. At this time, the direction in which the ruled lines Ln are arranged in the first pattern Pt1 and the direction in which the gaps are arranged in the second pattern Pt2 need only match.

The numerical values "−3" to "+3" illustrated in FIG. 4 indicate the landing deviation amount of the ink to be detected and, although not printed in this exemplary embodiment, may be printed. An upper limit of the numerical values is set as appropriate in accordance with the landing deviation amount to be measured. FIG. 4 illustrates a state in which a ruled line Ln0 corresponding to the deviation amount "0" aligns with the position of, among the gaps Sp, a gap Sp0 having the deviation amount "0". That is, FIG. 4 illustrates, as an example, a state in which the landing deviation between the first pattern Pt1 and the second pattern Pt2 is zero and a landing deviation has not occurred. This state in which "the ruled line Ln aligns with the position of the gap Sp" refers to a state in which the overlap between one of the plurality of ruled lines Ln and one of the plurality of gaps Sp is largest in the test pattern 40. In the exemplary embodiment, each dot of the ruled line Ln0 is disposed in the gap Sp0 without coming into contact with the base regions Gr, and the overlapping area between the ruled line Ln0 and the gap Sp0 is largest. However, when each of the ruled lines Ln comes into contact with the base regions Gr, for example, this refers to, among the ruled lines Ln, the ruled line Ln in a state in which the area overlapping with the gap Sp is largest.

The gaps Sp are provided equally spaced apart from each other by the distance Ds as described above. In contrast, the gaps between the ruled lines Ln are not equally spaced apart, but formed to incrementally deviate by a respective distance corresponding to the landing deviation amount of the ink. Next, the configuration of the ruled lines Ln will be described.

FIG. 4 schematically illustrates distances D1 to D3 between the ruled lines Ln. The distance D1 is the distance to the ruled line Ln1 being adjacent from the ruled line Ln0. The distance D1 is set, for example, to any distance obtained by adding a minimum unit of the landing deviation amount of the ink to be detected to the distance Ds of the gaps Sp. In the exemplary embodiment, the distance D1 is a distance obtained by adding the distance corresponding to one dot to the distance Ds. The distance D2 is set to a distance obtained by further adding the distance Ds and the distance corresponding to one dot, from the position of the ruled line Ln1. That is, the distance D2 is the distance of 2 times the distance Dx plus the distance corresponding to two dots, from the position of the ruled line Ln0. Thus, the distance of the ruled line Ln is set to incrementally deviate by one dot as the ruled line Ln separates from the ruled line Ln0. This incrementally deviated "1 dot" is set to match the minimum unit of the landing deviation amount to be measured. That is, the "1 dot" can be changed as appropriate in accordance with the landing deviation amount to be measured. Thus, in a case where there is a landing deviation amount in the X direction between the first pattern Pt1 and the second pattern Pt2, the ruled line Ln corresponding to the landing deviation amount is set to match the position of the gap Sp corresponding to the landing deviation amount. The positive and negative signs assigned to the landing deviation amount illustrated in FIG. 4 represent the positive side and the negative side in the X direction relative to the deviation amount "0". The ruled line Ln is provided at a position linearly symmetric on both sides in the X direction of the ruled line Ln0 in a manner that corresponds to these positive and negative signs. Note that, with at least a portion of the first pattern Pt1 and at least a portion of the second pattern Pt2 overlapping each other, the ruled lined Ln need only be disposed at the positions of the gaps Sp corresponding to the landing deviation amount, and the respective regions of the first pattern Pt1 and the second pattern Pt2 need not be formed overlapping to completely coincide with each other. Next, a method for acquiring the landing deviation amount of the ink by the printing device 20 according to the exemplary embodiment will be described using FIG. 5 and FIG. 6.

Figure 5:
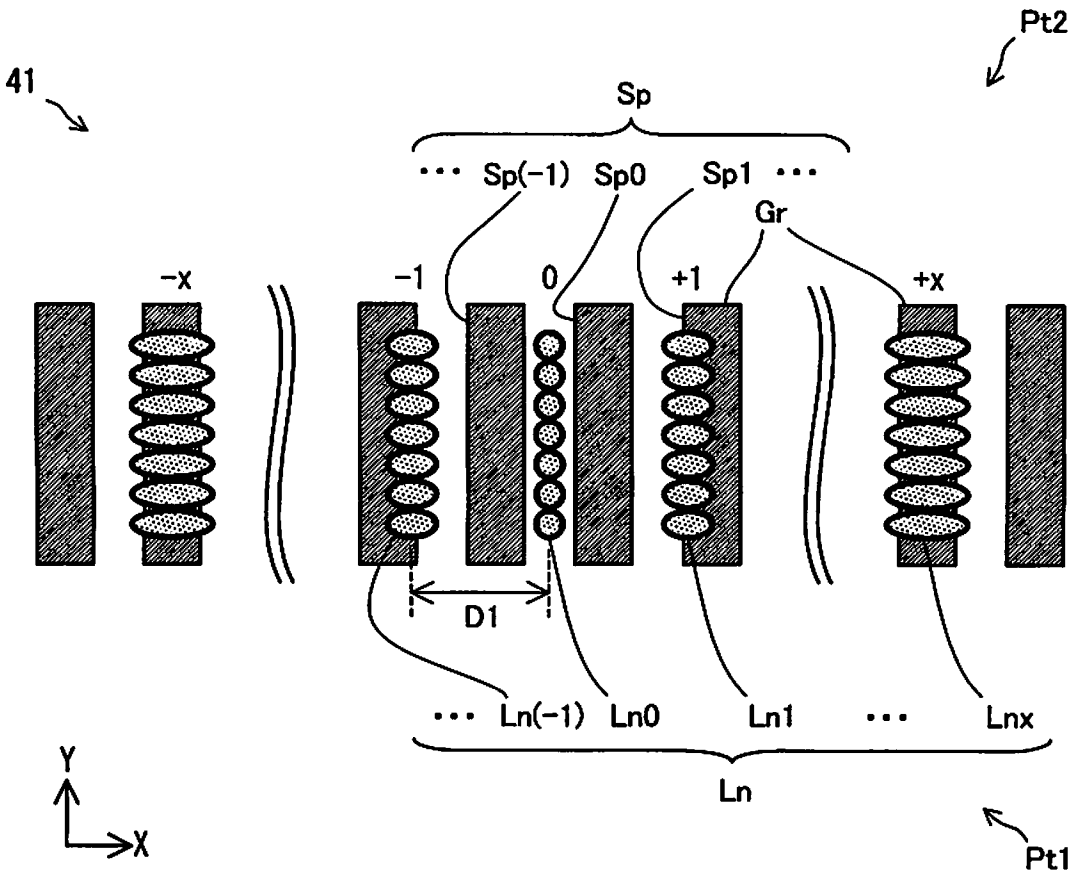
FIG. 5 is an enlarged view illustrating a relationship between ruled lines and base regions on a printing medium, expressed in dots.

FIG. 5 is an enlarged view schematically illustrating the relationship between the ruled lines Ln and the base regions Gr on the printing medium MD, expressed in dots. The base region Gr is formed by dots in the same way as the ruled line Ln, but is represented in block form for ease of understanding of the technique. FIG. 5 illustrates a state in which the ruled line Ln0 corresponding to the deviation amount "0" aligns with the position of, among the gaps Sp, the gap Sp0 corresponding to the deviation amount "0", as in FIG. 4.

The ruled lines Ln, as described above, are dot rows in which the ink dots of the colored ink magenta are arranged in straight lines along the Y direction. The ruled line Ln0 is constituted by the ink dots of the magenta ink that landed in the gap Sp0. In other words, the ruled line Ln0 is constituted by the ink dots of the magenta ink that landed directly on the printing medium MD without coming into contact with the base regions Gr. Here, the shape of the magenta ink depends on a permeability and a degree of bleeding between the magenta ink, the printing medium MD on which the magenta ink lands, and the transparent ink. As described above, in the printing device 20 according to the exemplary embodiment, a combination of the type of the printing medium MD and the type of the ink is set so that the permeability of the colored ink into the printing medium MD is low. The magenta ink that lands on the printing medium MD is less likely to penetrate into the printing medium MD, and maintains a substantially circular shape, which is the ink dot shape. As a result, the ruled line Ln0 formed in the gap Sp0 is constituted by a substantially circular dot row as illustrated in FIG. 5. On the other hand, the magenta ink that lands on the transparent ink can be made to bleed by the mixing of the inks by controlling discharge so that the ink lands before coagulation of the transparent ink. As a result, the magenta ink that lands on the transparent ink visually has a shape that is distorted from the substantially circular shape of the ink dot shape. The degree of distortion of the shape of the magenta ink that lands on the transparent ink differs depending on the amount of contact between the transparent ink and the magenta ink. For example, when the ruled line Ln corresponding to the "+1" deviation amount is defined as the ruled line Ln1, each dot constituting the ruled line Ln1 is made to bleed from partial contact with the transparent ink. As a result, dots having a larger area than that of the substantially circular dots of the ruled line Ln0 are formed. Further, the ruled line Ln corresponding to the "+x" deviation amount is defined as the ruled line Lnx. When the dots of the ruled line Lnx all land on the transparent ink, the bleeding of each dot of the magenta ink is largest, and thus the area of each dot is largest.

Thus, when there is a landing deviation amount in the X direction between the first pattern Pt1 and the second pattern Pt2, the ruled line Ln corresponding to the landing deviation amount is set to match the position of any one of the gaps Sp. For example, when the magenta ink lands with a landing deviation amount of +1 dot relative to the landing position of the transparent ink, the ruled line Ln1 is deviated by one dot, causing the ink to land in the gap Sp1 without coming into contact with the base region Gr. At this time, each dot in the dot row of the ruled line Ln1 is substantially circular. In this manner, in the test pattern 40, each dot shape of the ruled line Ln is formed in the gap Sp in accordance with the landing deviation amount in the X direction, and is substantially circular.

Figure 6:
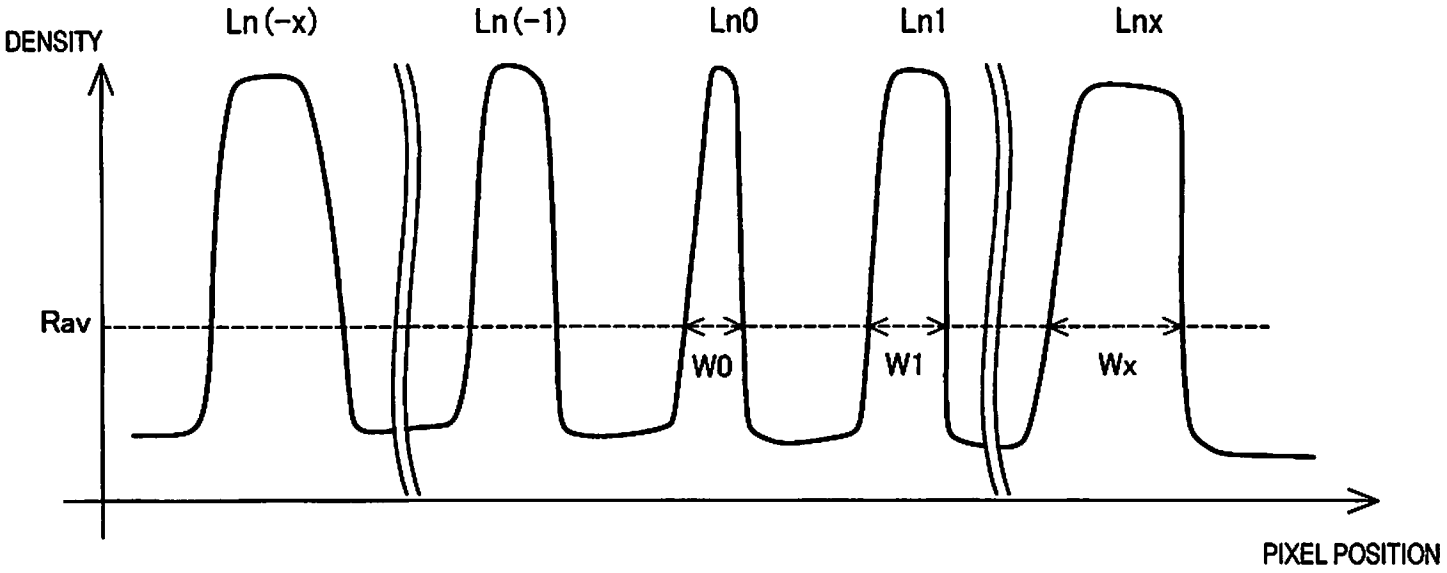
FIG. 6 is a graph illustrating a relationship between a pixel position and a density value acquired from the test pattern.

FIG. 6 is a graph illustrating a relationship between a pixel position and a density acquired from the test pattern 40. FIG. 6 illustrates the extracted density values corresponding to the five ruled lines Ln in FIG. 5. As illustrated in FIG. 6, the density values of the respective ruled lines Ln formed by the magenta ink are greater than the density values of the transparent ink and the printing medium MD.

The relationship between the pixel position and the density value illustrated in FIG. 6 is realized by positional control of the carriage 25 by the control unit 21 and measurement by the area sensor 36. As described above, because the base region Gr is formed by the transparent ink, a change in the density value from the area sensor 36 does not readily appear, making it difficult to determine the landing position on the printing medium MD. In contrast, the dot rows of colored ink are recognized by the area sensor 36, and peak portions having high density values are formed. Here, a density value Ram illustrated in FIG. 6 is an average value of the acquired density values. The printing device 20 according to the exemplary embodiment acquires the width of each peak at the density value of this density value Rav, in pixels.

Widths W0, W1, and Wx in the drawing respectively correspond to the ruled line Ln0, the ruled line Ln1, and the ruled line Lnx. The position of the finest ruled line Ln of the ruled lines Ln is acquired by reading the portion where the width at the density value Rav is minimum, as with the ruled line Ln0 illustrated in FIG. 5. In FIG. 6, the minimum width at the density value Rav is the width W0 corresponding to the ruled line Ln0. The landing deviation amount corresponding to this acquired ruled line Ln indicates the landing deviation amount between the transparent ink and the colored ink. Thus, the landing deviation amount between the transparent ink and the colored ink is acquired using a change in the width of the ruled line Ln corresponding to the degree of bleeding of the colored ink. In the exemplary embodiment, because the degree of bleeding of the colored ink on the printing medium MD is small, the printing device 20 acquires the landing deviation amount from the ruled line Ln having the smallest thickness of the ruled lines Ln, that is, from the ruled line Ln exhibiting, of extrema of the widths of the ruled line Ln, the minimum value. In the example in FIG. 6, the landing deviation amount "0" is acquired from the ruled line Ln0 exhibiting, of the extrema of the widths of the ruled line L, the minimum value. Next, various controls of the print processing including the landing deviation amount acquisition processing executed by the printing device 20 will be described.

Figure 7:
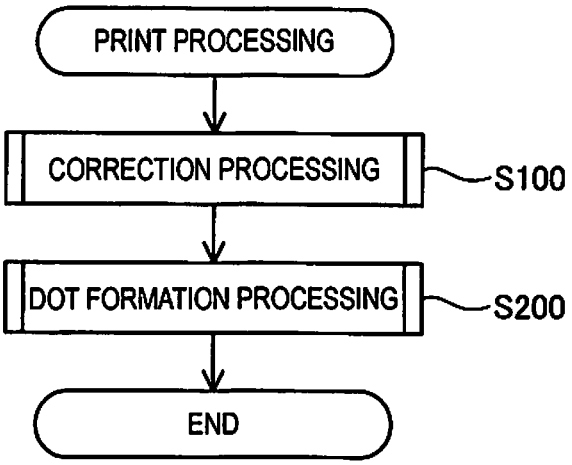
FIG. 7 is a flowchart illustrating print processing performed by a control unit of the printing device.

FIG. 7 is a flowchart illustrating the print processing performed by the control unit 21 of the printing device 20. The print processing is executed by the CPU 22 that read the program stored in the memory 23. The print processing is started, for example, by a user pressing a print start button on the printing device 20. In step S100, the CPU 22 executes correction processing. The correction processing is processing for correcting the landing deviation amount of the transparent ink.

Figure 8:
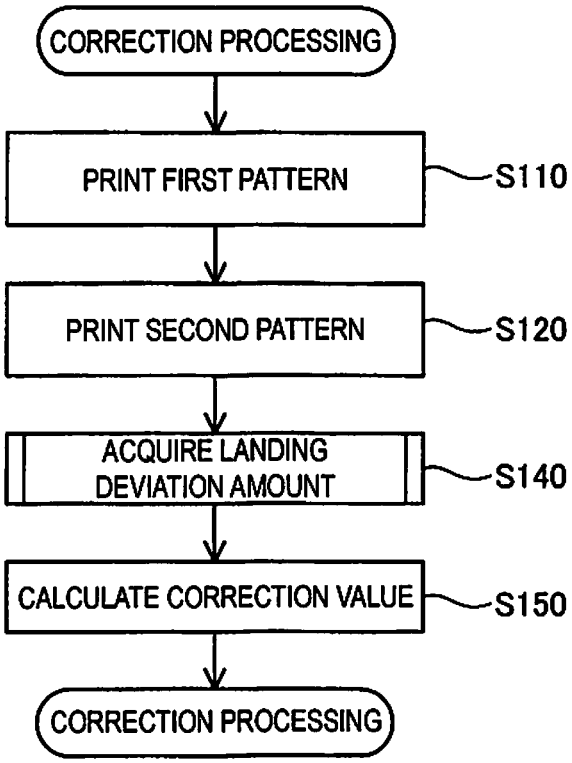
FIG. 8 is a flowchart illustrating correction processing executed by a CPU.

FIG. 8 is a flowchart illustrating the correction processing executed by the CPU 22. In step S110, the CPU 22 controls the transparent ink print head 30*op* to print the first pattern Pt1 and form the base regions Gr on the printing medium MD. In step S120, the CPU 22 controls the magenta ink print head 30M serving as the colored ink print head to print the second pattern Pt2 in a manner overlapping the first pattern Pt1 on the printing medium MD and form the ruled lines Ln. This completes the printing of the test pattern 40 including the first area 41 to the fourth area 44.

Figure 9:
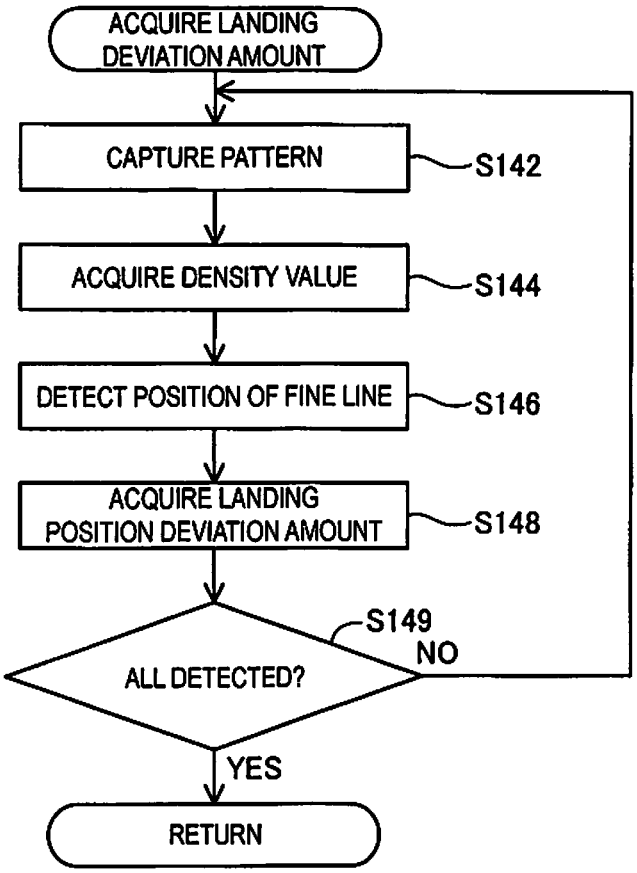
FIG. 9 is a flowchart of landing deviation amount acquisition processing executed by a CPU.

FIG. 9 is a flowchart of the landing deviation amount acquisition processing executed by the CPU 22. The landing deviation amount acquisition processing is processing for acquiring the landing deviation amount between the transparent ink and the colored ink using the test pattern 40. In step S142, the CPU 22 captures an image of the test pattern 40 with the area sensor 36. The image capturing of the test pattern 40 is started from the first area 41, and is performed by combining main scanning and sub scanning along with ink printing.

After the image capturing of the test pattern 40 is started and the image capturing of the first area 41 serving as the first image capturing location ends, the landing deviation amount acquisition processing is started in parallel with the image capturing of the other area in step S144. The CPU 22 reads the density value acquired by the area sensor 36 to acquire the change data of the density value. In step S146, the change data of the density value is read to acquire the width of each peak of the density value at the density value Ray. The CPU 22 acquires the position of the finest ruled line Ln among the ruled lines Ln by reading the peak position having the minimal width value among the acquired width of each peak. In step S148, the CPU 22 acquires the landing position deviation amount corresponding to the ruled line Ln of the position of this acquired ruled line Ln, and records the landing position deviation amount in the memory 23. In step S149, the CPU 22 checks whether or not detection of the landing deviation amount in all test patterns 40 from the first area 41 to the fourth area 44 has been completed. This means that the CPU 22 checks whether detection of the landing deviation amount between the first print chip 31M to the fourth print chip 34M of the magenta print head 30M and the first print chip 31*op* to the fourth print chip 34*op* of the transparent ink print head 30*op* has been completed. When detection of all test patterns 40 has not been completed (S149: NO), images of the remaining test patterns 40 are acquired. When detection of all test patterns 40 has been completed (S149: YES), the ruled line detection processing ends.

Returning to FIG. 8, in step S150, the CPU 22 calculates the correction values corresponding to each print head from the respective landing deviation amount from the first area 41 to the fourth area 44 of the test pattern 40. The calculated correction values are stored in the memory 23 in a non-volatile manner. Next, processing by the CPU 22 transitions to dot formation processing as illustrated in FIG. 7.

Figure 10:
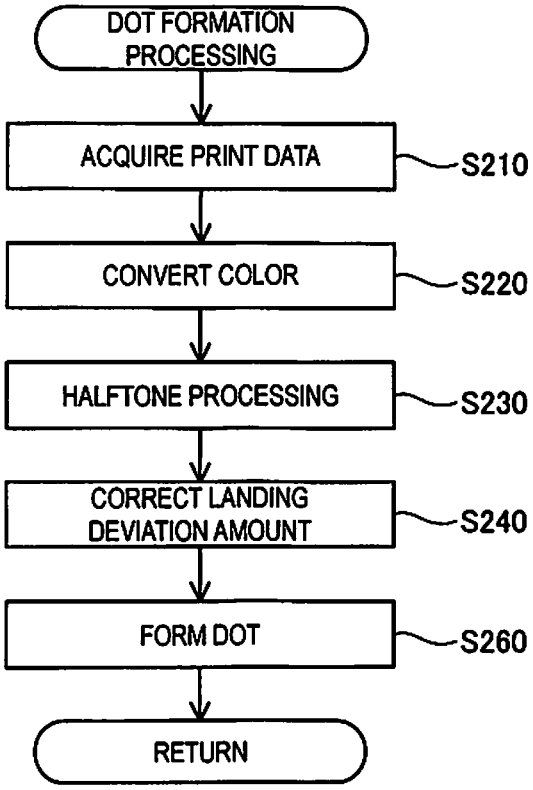
FIG. 10 is a flowchart illustrating dot formation processing executed by a CPU.

FIG. 10 is a flowchart illustrating the dot formation processing of step S200 executed by the CPU 22. In step S210, the CPU 22 acquires print data to be printed. In step S220, the CPU 22 executes color conversion for converting print data represented by red, green, and blue (RGB) into ink values according to the CMYKLcLm color system. In step S230, the CPU 22 executes halftone processing. For the halftone processing, various halftone processing such as a dither method, an error diffusion method, and the like can be used. In step S240, the landing deviation amount is corrected. More specifically, the dot data acquired by the halftone processing is adjusted by the correction values recorded in the memory 23 in step S150. In step S260, the corrected dot data described above is used to form ink dots on the printing medium MD. In step S260, a dot by the transparent ink is formed in addition to that by the colored ink, as appropriate. When dot formation is completed based on the print data, the dot formation processing is ended and the print processing is ended.

As described above, according to the printing device 20 of the exemplary embodiment, the first pattern Pt1 by the colored ink and the second pattern Pt2 by the transparent ink are formed overlapping. At this time, there are formed locations where the ruled lines Ln formed by the colored ink and the gaps Sp formed by the transparent ink overlap each other, and locations where the ruled lines Ln and the base regions Gr formed by the transparent ink overlap due to being incrementally deviated by a respective distance corresponding to the landing deviation amount of the ink. As a result, the positions where the colored ink and the transparent ink overlap and do not overlap can be identified from the dot shape corresponding to the degree of bleeding of the colored ink in the gap Sp and on the transparent ink. In this exemplary embodiment, the relative landing deviation amount between the colored ink and the transparent ink can be identified by reading this non-overlapping position from the formed test pattern 40. Thus, the relative landing deviation amount between the colored ink and the transparent ink can be identified by a simple method without detection of the transparent ink.

In this exemplary embodiment, the width of the dot row of the colored ink formed on the printing medium MD without overlap between the colored ink and the transparent ink is narrower than the width of the dot row of the colored ink formed overlapping with the base region Gr of the transparent ink. That is, here the degree of bleeding of the colored ink on the printing medium MD is smallest. In the printing device 20 according to the exemplary embodiment, the landing deviation amount is acquired given the location where the ruled line Ln has the smallest thickness as the ruled line Ln disposed in the gap Sp. Thus, the ruled line Ln in which the colored ink that landed on the printing medium MD is closest to a dot shape is recognized to detect the landing deviation amount, making it possible to enhance a detection accuracy of the landing deviation amount to be acquired.

B. Second Exemplary Embodiment

Figure 11:
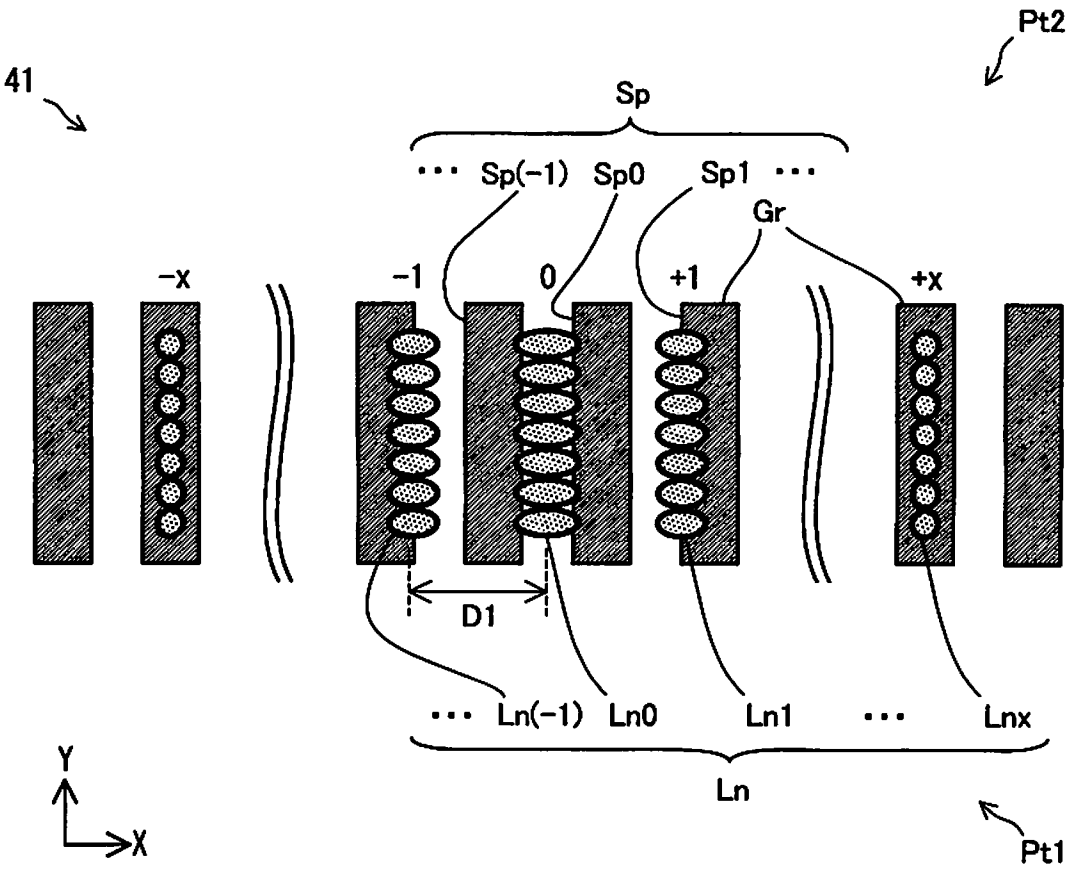
FIG. 11 is an enlarged view illustrating a relationship between ruled lines and base regions on a printing medium according to a second exemplary embodiment.

FIG. 11 is an enlarged view schematically illustrating the relationship between the ruled lines Ln and the base regions Gr on the printing medium MD in a second exemplary embodiment. As the printing medium MD of the exemplary embodiment, plain paper is employed. The printing medium MD is not limited to plain paper, and printing paper having high ink permeability compared to photographic paper and glossy paper can be employed. Further, a dye ink is employed as the ink of this exemplary embodiment. The ink is not limited to a dye ink, and various inks having high permeability into the printing medium MD can be employed. Thus, in this exemplary embodiment, a combination of the type of the printing medium MD and the type of the ink is set so that the permeability of the colored ink into the printing medium MD is high. Except for the above, the configuration of the printing device 20 according to the second exemplary embodiment is the same as that of the printing device 20 according to the first exemplary embodiment. Below, similar to the first exemplary embodiment, a magenta ink is used as an example of the colored ink.

The magenta ink that lands on the printing medium MD in the gap Sp readily bleeds on the printing medium MD, which is plain paper, and thus readily changes shape from the substantially circular shape. In FIG. 11, the shape of the magenta ink that lands on the printing medium MD is schematically illustrated as a substantially elliptical shape. On the other hand, the transparent ink and the magenta ink are set that the bleeding of the magenta ink on the transparent ink is suppressed by, for example, executing control so that the magenta ink is discharged after coagulation of the transparent ink. As a result, the magenta ink that lands on the transparent ink maintains a substantially circular shape, which is the ink dot shape at the time of landing.

As in the first exemplary embodiment, the printing device 20 acquires the density value of the ruled line Ln by the area sensor 36, and acquires the width of each peak at the density value Rav in pixels. In the printing device 20 according to the exemplary embodiment, unlike the first exemplary embodiment, the landing deviation amount is acquired given the ruled line Ln exhibiting the maximum value of the extrema of the widths of the ruled lines L at the density value Rav as the ruled line Ln disposed in the gap Sp. In FIG. 11, the ruled line Ln in which the width at the density value Rav is the maximum value is the ruled line Ln0. Thus, in the second exemplary embodiment, a difference in the shape of the landed ink between the colored ink that lands in the gap Sp and exhibits a significant shape change due to bleeding, and the colored ink that is on the transparent ink and exhibits a minimal shape change is used to acquire the landing deviation amount between the colored ink and the transparent ink.

The information of the combination of each ink and the printing medium MD in relation to the bleeding of the ink is stored in advance in the memory 23 as setting values of the print processing, similar to the first exemplary embodiment. In the printing device 20 according to this exemplary embodiment, when the print processing described above is executed, the CPU 22 reads this information from the memory 23 and thus changes the detection method of the ruled line Ln for detecting the landing deviation amount as described above from the detection method in the first exemplary embodiment. In other words, the printing device 20 changes the thickness of the ruled line Ln detected to acquire the landing deviation amount in accordance with the degree of bleeding of the colored ink on the printing medium MD and the transparent ink. As a result, the landing deviation amount can be appropriately detected in accordance with the printing medium MD and the ink used.

C. Other Exemplary Embodiments (C1) In each of the exemplary embodiments described above, the transparent ink is utilized in the preprocessing prior to the printing of the colored ink, and discharging of the colored ink is executed after discharging of the transparent ink. In contrast, an aspect may be adopted in which discharging of the transparent ink is executed after discharging of the colored ink. The transparent ink can be employed as an ink printed to overlap the colored ink and used for image quality control of the printed image. In the printing device of this exemplary embodiment, the first pattern Pt1 of the colored ink and the second pattern Pt2 of the transparent ink are printed overlapping. The colored ink is printed to the extent that allows detection by the area sensor and under conditions in which a degree of bleeding occurs with the transparent ink. The difference in the degree of bleeding of the colored ink may be recognizable with the area sensor by the sequential order and duration of the ink to be printed, the permeability into the printing medium, and the like.

(C2) In each of the exemplary embodiments described above, the gaps Sp are provided equally spaced by the distance Ds. However, the gaps Sp may not be equally spaced. An aspect may be adopted in which the relative positional relationship between the ruled lines Ln of the first pattern Pt1 and the gaps Sp of the second pattern Pt2 is a positional relationship of being incrementally deviated by a respective distance corresponding to the landing deviation amount of the ink to be detected. When a certain ruled line Ln overlaps with one of the plurality of gaps Sp, at least a portion of the other ruled lines Ln and at least a portion of the base regions Gr need only be formed in each of the positions incrementally deviated and overlapping by a respective distance corresponding to the landing deviation amount of the ink.

(C3) In each of the exemplary embodiments described above, the test pattern 40 is used for measuring the landing deviation amount in the X direction between print heads. In contrast, the test pattern is not limited to the purpose of measuring the landing deviation amount in the X direction. For example, the landing deviation amount in the Y direction may be measured by employing a test pattern obtained by rotating the test pattern 40 by 90 degrees. Various test patterns that measure the relative landing deviation amount between the colored ink and the transparent ink can be employed.

(C4) In each of the exemplary embodiments described above, the distance of the ruled line Ln of the first pattern Pt1 of the test pattern 40 is set to incrementally increase by one dot sequentially, as in "+1" "+2" "+3", as the ruled line Ln separates from the ruled line Ln0 toward the positive side. In contrast, the order of the incremental deviation amount may be set to incrementally decrease by one dot sequentially, such as "+3", "+2", "+1", as the ruled line Ln separates from the ruled line Ln0 toward the positive side. Furthermore, the order of the incremental deviation amount may be set to an appropriate order, such as "+3" "+1" "+1" "+2", relative to the separation from the ruled line Ln0. The same applies to the negative side from the ruled line Ln0 as well.

(C5) In each of the exemplary embodiments described above, the density value acquired by the area sensor 36 is used to detect the landing deviation. In contrast, an aspect may be adopted in which acquisition of the landing deviation amount is achieved by measuring a luminance value rather than a density to recognize each of the ruled lines.

(C6) In each of the exemplary embodiments described above, magenta is described as an example of the colored ink used for acquiring the landing deviation amount. However, the colored ink is not limited to magenta ink, and other ink colors such as cyan or black may be used.

D. Other Embodiments

The present disclosure is not limited to the exemplary embodiments described above, but may be implemented in various forms without departing from the spirit of the disclosure. For example, the present disclosure may be achieved through the following forms. Technical features in the above-described exemplary embodiments, which correspond to the technical features in the aspects described below, can appropriately be replaced or combined to address some or all of the issues to be solved by the disclosure or to achieve some or all of the effects of the disclosure. Additionally, when the technical features are not described herein as essential technical features, such technical features may be deleted appropriately.

(1) According to an aspect of the present disclosure, a test pattern formation method for a recording device including a first discharge unit configured to discharge colored ink onto a recording medium, and a second discharge unit configured to discharge transparent ink onto the recording medium, is provided. The test pattern formation method includes preparing a first pattern including a plurality of dot rows separated in a direction intersecting the plurality of dot rows, and a second pattern including a plurality of regions having a width greater than a width of the plurality of dot rows, the plurality of regions being provided in the direction and spaced apart by a plurality of gaps greater than or equal to the width of the plurality of dot rows. At least a portion of the first pattern discharged by driving of the first discharge unit and at least a portion of the second pattern discharged by driving of the second discharge unit may be in positions overlapping each other. In this position, given a largest overlap between one of the plurality of dot rows and one of the plurality of gaps as a reference, the other dot rows of the plurality of dot rows and the plurality of regions overlap at positions that deviate from each other incrementally by a distance corresponding to a landing deviation amount. According to the test pattern formation method of this aspect, the first pattern by the colored ink and the second pattern by the transparent ink are formed overlapping. At this time, there are formed locations where the dot rows formed by the colored ink and the gaps formed by the transparent ink overlap each other, and locations where the dot rows and the regions having a wide width formed by the transparent ink overlap due to being incrementally deviated by a respective distance corresponding to the landing deviation amount of the ink. As a result, the positions where the colored ink and the transparent ink overlap can be identified from the dot shape corresponding to the degree of bleeding of the colored ink in the gap and on the transparent ink. Thus, with the formed test pattern, the relative landing deviation amount between the colored ink and the transparent ink can be identified by a simple method without detection of the transparent ink.

(2) According to another aspect of the present disclosure, a landing deviation amount acquisition method for acquiring a landing deviation amount that is generated when recording is performed using a recording device including a first discharge unit configured to discharge colored ink onto a recording medium, and a second discharge unit configured to discharge transparent ink onto the recording medium, the landing deviation amount being generated between the first discharge unit and the second discharge unit, is provided. This landing deviation amount acquisition method includes preparing a first pattern including a plurality of dot rows separated in a direction intersecting the plurality of dot rows, and a second pattern including a plurality of regions having a width greater than a width of the plurality of dot rows, the plurality of regions being provided in the direction and spaced apart by a plurality of gaps greater than or equal to the width of the plurality of dot rows. At least a portion of the first pattern discharged by driving of the first discharge unit and at least a portion of the second pattern discharged by driving of the second discharge unit are formed in positions overlapping each other. In this position, given a largest overlap between one of the plurality of dot rows and one of the plurality of gaps as a reference, the other dot rows of the plurality of dot rows and the plurality of regions overlap at positions that deviate from each other incrementally by a distance corresponding to a landing deviation amount. The method further includes detecting the first pattern, and acquiring a landing deviation amount between the first discharge unit and the second discharge unit based on a position of a dot row having a width of extrema among the plurality of dot rows detected. According to the landing deviation amount acquisition method of this aspect, the first pattern by the colored ink and the second pattern by the transparent ink may be formed overlapping. At this time, there are formed locations where the dot rows formed by the colored ink and the gaps formed by the transparent ink overlap each other, and locations where the dot rows and the regions having a wide width formed by the transparent ink overlap due to being incrementally deviated by a respective distance corresponding to the landing deviation amount of the ink. As a result, the positions where the colored ink and the transparent ink overlap can be identified from the dot shape corresponding to the degree of bleeding of the colored ink in the gap and on the transparent ink. Thus, with the formed test pattern, the relative landing deviation amount between the colored ink and the transparent ink can be identified by a simple method without detection of the transparent ink.

(3) In the landing deviation amount acquisition method according to the aspect described above, a degree of bleeding of the colored ink discharged may be determined by a combination of the recording medium, the colored ink, and the transparent ink, and the landing deviation amount may be acquired from a position of the dot row exhibiting, of the extrema, one of a maximum or a minimum, in accordance with the combination. The shape of the landed colored ink depends on the permeability, the degree of bleeding, and the like between the colored ink, the recording medium on which the colored ink lands, and the transparent ink. According to the landing deviation amount acquisition method for the recording device of this aspect, the thickness of the dot row detected to acquire the landing deviation amount is changed in accordance with the degree of bleeding of the colored ink on the printing medium and the transparent ink. By appropriately switching, based on the information of the printing medium and the ink used, the object of the dot row to be detected in order to acquire the landing deviation amount, it is possible to appropriately detect the landing deviation amount in accordance with the recording medium and the ink used.

(4) In the landing deviation amount acquisition method according to the aspect described above, the landing deviation amount may be acquired by a position of the dot row exhibiting, of the extrema, a minimum when a width of the dot row formed on the recording medium without overlap between the colored ink and the transparent ink is narrower than a width of the dot row formed with overlap between the colored ink and the transparent ink. According to the landing deviation amount acquisition method for the recording device of this aspect, the landing deviation amount is detected by recognizing a dot row in which the landing colored ink is closest to a dot shape. Accordingly, a detection accuracy of the landing deviation amount to be acquired can be enhanced.

(5) According to another aspect of the present disclosure, a recording device including a first discharge unit configured to discharge colored ink onto a recording medium, and second discharge unit configured to discharge a transparent ink onto the recording medium, is provided. The recording device further includes a control unit configured to control the first discharge unit and the second discharge unit. The control unit is configured to form a first pattern formed by the first discharge unit and including a plurality of dot rows separated in a direction intersecting the plurality of dot rows, and a second pattern formed by the second discharge unit and including a plurality of regions having a width greater than a width of the plurality of dot rows, the plurality of regions being provided in the direction and spaced apart by a plurality of gaps greater than or equal to the width of the plurality of dot rows. At least a portion of the first pattern discharged by driving of the first discharge unit and at least a portion of the second pattern discharged by driving of the second discharge unit are formed in positions overlapping each other. In this position, given a largest overlap between one of the plurality of dot rows and one of the plurality of gaps as a reference, the other dot rows of the plurality of dot rows and the plurality of regions overlap at positions that deviate from each other incrementally by a distance corresponding to a landing deviation amount. According to the recording device of this aspect, the first pattern by the colored ink and the second pattern by the transparent ink are formed overlapping. At this time, there are formed locations where the dot rows formed by the colored ink and the gaps formed by the transparent ink overlap each other, and locations where the dot rows and the regions having a wide width formed by the transparent ink overlap due to being incrementally deviated by a respective distance corresponding to the landing deviation amount of the ink. As a result, the positions where the colored ink and the transparent ink overlap can be identified from the dot shape corresponding to the degree of bleeding of the colored ink in the gap and on the transparent ink.

(6) The recording device of the aspect described above may further include an imaging unit controlled by the control unit and configured to image the recording medium. The control unit may be configured to detect the first pattern by the imaging of the imaging unit, acquire a landing deviation amount between the first discharge unit and the second discharge unit based on a position of a dot row having a width of extrema among the plurality of dot rows detected, and correct a discharge position of the transparent ink by the second discharge unit in accordance with the landing deviation amount acquired and perform printing. According to the recording device of this aspect, the control unit of the recording device, with the formed test pattern, can identify the relative landing deviation amount between the colored ink and the transparent ink by a simple method without detection of the transparent ink. The recording device can perform recording of high image quality which is corrected landing deviation amount by using the correction value calculated from the identified landing deviation amount.

Various forms of the present disclosure besides the recording device may also be implemented. For example, the present disclosure can be implemented in many forms including a manufacturing method for a recording device, a control method for a recording device, a recording method, a recording system including an encoding device and a recording device, a computer program for realizing such a device, a method, or a system, and a non-transitory storage medium storing the computer program.

What is claimed is:

1. A test pattern formation method for a recording device including a first discharge unit configured to discharge colored ink onto a recording medium, and a second discharge unit configured to discharge transparent ink onto the recording medium, the method comprising:

preparing a first pattern including a plurality of dot rows each of which is formed of a plurality of dots arranged in a direction and which are separated from each other in an orthogonal direction orthogonal to the direction, and a second pattern including a plurality of regions having a width greater than a width of the plurality of dot rows, the plurality of regions being provided in the orthogonal direction and spaced apart in the orthogonal direction by a plurality of gaps greater than or equal to the width of the plurality of dot rows, wherein at least a portion of the first pattern discharged by driving of the first discharge unit and at least a portion of the second pattern discharged by driving of the second discharge unit are formed in positions overlapping each other, where given a largest overlap between one of the plurality of dot rows and one of the plurality of gaps as a reference, the other dot rows of the plurality of dot rows and the plurality of regions overlap at positions that deviate from each other incrementally by a distance corresponding to a landing deviation amount.

2. A landing deviation amount acquisition method for acquiring a landing deviation amount that is generated when recording is performed using a recording device including a first discharge unit configured to discharge colored ink onto a recording medium, and a second discharge unit configured to discharge transparent ink onto the recording medium, the landing deviation amount being generated between the first discharge unit and the second discharge unit, the method comprising:

preparing a first pattern including a plurality of dot rows each of which is formed of a plurality of dots arranged in a direction and which are separated from each other in an orthogonal direction orthogonal to the direction, and a second pattern including a plurality of regions having a width greater than a width of the plurality of dot rows, the plurality of regions being provided in the orthogonal direction and spaced apart in the orthogonal direction by a plurality of gaps greater than or equal to the width of the plurality of dot rows, at least a portion of the first pattern discharged by driving of the first discharge unit and at least a portion of the second pattern discharged by driving of the second discharge unit being formed in positions overlapping each other, where given a largest overlap between one of the plurality of dot rows and one of the plurality of gaps as a reference, the other dot rows of the plurality of dot rows and the plurality of regions overlap at positions that deviate from each other incrementally by a distance corresponding to a landing deviation amount;

detecting the first pattern; and acquiring a landing deviation amount between the first discharge unit and the second discharge unit based on a position of a dot row having a width of extrema among the plurality of dot rows detected.

3. The landing deviation amount acquisition method according to claim 2, wherein a degree of bleeding of the colored ink discharged is determined by a combination of the recording medium, the colored ink, and the transparent ink, and the landing deviation amount is acquired from a position of the dot row exhibiting, of the extrema, one of a maximum or a minimum, in accordance with the combination.

4. The landing deviation amount acquisition method according to claim 2, wherein the landing deviation amount is acquired by a position of the dot row exhibiting, of the extrema, a minimum when a width of the dot row formed on the recording medium without overlap between the colored ink and the transparent ink is narrower than a width of the dot row formed with overlap between the colored ink and the transparent ink.

* * * * *